US006412379B1

(12) United States Patent
Turusaki

(10) Patent No.: US 6,412,379 B1
(45) Date of Patent: Jul. 2, 2002

(54) AUTOMATIC PUNCHING APPARATUS

(75) Inventor: Katunobu Turusaki, Saga-ken (JP)

(73) Assignee: Mikawa Iron Works Corporation, Saga-Ken (JP)

( * ) Notice: Subject to any disclaimer, the term of this patent is extended or adjusted under 35 U.S.C. 154(b) by 0 days.

(21) Appl. No.: 09/597,257

(22) Filed: Jun. 19, 2000

(30) Foreign Application Priority Data

Jul. 9, 1999 (JP) ..... 11-196477

(51) Int. Cl.[7] ..... B26D 5/20; B31B 1/06
(52) U.S. Cl. ..... 83/155.1; 83/277
(58) Field of Search ..... 83/151, 155, 102, 83/325, 277, 154, 155.1, 206, 168

(56) References Cited

U.S. PATENT DOCUMENTS 4,026,199 A * 5/1977 Adams et al. ..... 83/155.1
4,175,477 A * 11/1979 Inose et al. ..... 493/373
4,371,369 A * 2/1983 Wright, III ..... 493/373
4,420,998 A * 12/1983 Tokuno et al. ..... 83/325
4,466,318 A * 8/1984 Schoch ..... 83/277
4,466,320 A * 8/1984 Tokuno et al. ..... 83/325
4,485,708 A * 12/1984 Halff et al. ..... 83/277
4,612,006 A * 9/1986 Tokuno et al. ..... 83/151
4,767,393 A * 8/1988 Smith ..... 83/321
5,154,689 A * 10/1992 Modoux et al. ..... 83/155.1
5,197,938 A * 3/1993 Chmielewski ..... 83/102

FOREIGN PATENT DOCUMENTS

JP H7-54188 12/1995

* cited by examiner

*Primary Examiner*—Allan N. Shoap
*Assistant Examiner*—Stephen Choi
(74) *Attorney, Agent, or Firm*—Rader, Fishman & Grauer, PLLC

(57) ABSTRACT

A scraping bar is disposed between the positions corresponding to endless chains of a thin sheet material transferring member. A nipping mechanism is disposed behind the scraping bar in its travelling direction. A thin sheet material having been subjected to the punching step, which is nipped by the nipping mechanism, is pulled together with the scraping bar to carry out a transfer step. Disused portions of the thin sheet material remaining on a lower surface plate is pushed out by means of the other scraping bar subsequently passing between the upper and lower surface plates. It is possible to transfer the thin sheet material in a stable manner by the scraping bar, thus permitting to carry out a high-speed transfer step. There is no need for formation of uncut portions between portions to be punched into a prescribed shape and the remaining disused portions and the punched products after the separation of the disused portions has an excellent finishing condition.

6 Claims, 9 Drawing Sheets

(A)

(B)

(A)

(B)

(C)

(A)

(B)

(C)

(A)

(B)

(C)

AUTOMATIC PUNCHING APPARATUS

BACKGROUND OF THE INVENTION

1. Field of the Invention

The present invention relates to an automatic punching apparatus for applying a punching step to a thin sheet material such as corrugated board, paperboard and the like to obtain pieces having a prescribed shape, and especially to an automatic punching apparatus which permits to perform the rapid punching step to a number of thin sheet materials and to obtain punched pieces having an excellent finishing condition after completion of removal of disused portions.

2. Description of the Related Art

A punching step is applied to a thin sheet material such as corrugated board, paperboard and the like to obtain punched pieces having a developed shape for products such as boxes with the use of an automatic punching apparatus. In such an apparatus, there is repeated a series of steps of feeding a thin sheet material to the apparatus, punching the thin sheet material into a prescribed developed shape by means of a punching die to prepare products (i.e., a punching step) and then removing disused portions (hereinafter referred to as "waste portions") other than the products from the thin sheet material, which has been subjected to the punching step (i.e., a waste removing step). FIGS. 6 and 7 show an example of the conventional automatic punching apparatus. FIG. 6 is a schematic constructional view of the conventional automatic punching apparatus and FIG. 7 is a view illustrating conditions of the thin sheet material in the respective steps in the conventional automatic punching apparatus.

The conventional automatic punching apparatus 100 as shown in FIGS. 6 and 7 is provided with a feed mechanism 110 for storing a plurality of thin sheet materials 50 in a stacked condition and feeding the thin sheet material 50 one by one at prescribed intervals to a subsequent zone; a punching mechanism 120 for punching the thin sheet material 50 into a prescribed shape by means of upper and lower dies; a thin sheet material transferring mechanism 130 disposed in the vicinity of the punching mechanism 120, for supplying the thin sheet material 50 fed from the feed mechanism 110 to the punching mechanism 120 and transferring the thin sheet material 50 having been subjected to the punching step from the punching mechanism 120; and a waste removing mechanism 140 disposed behind the punching mechanism 120, for removing the waste portions from the thin sheet material 50 having been subjected to the punching step.

The punching mechanism 120 is provided with an upper surface plate 121 to which the punching die is fixed; a lower surface plate 122 to which a faceplate corresponding to the above-mentioned punching die is fixed; and an elevating device 123 for moving the lower surface plate 122 up and down. Moving the lower surface plate 122 relative to the upper surface plate 121 carries out the punching step.

The thin sheet material transferring mechanism 130 is provided with a pair of endless chains 131 disposed on both sides, respectively, between which the punching mechanism 120 and the waste removing mechanism 140 locate, so as to circulate in a prescribed travelling direction; a driving device (not shown) for driving the endless chains 131 in a circulation motion in synchronization with the punching motion of the punching mechanism; a plurality of gripping bars 132 disposed between positions corresponding to the pair of endless chains, which are capable of passing between the upper and lower surface plates toward a side of the waste removing mechanism 140 in an interval of punching steps; and a nipping mechanism 133 fixed to the rear portion of the gripping bars 132, for nipping detachably the tip end portion of the thin sheet material 50 so as to permit to pull out the thin sheet material along with the movement of the gripping bars 132. In the thin sheet material transferring mechanism 130, an accurate drive and stop of the endless chains 131 can be performed by means of the driving device in synchronization with the upward or downward movement of the lower surface plate 122. When the punching step is applied to the thin sheet material 50 in the punching mechanism 120, the endless chains 131 cease to be driven. After completion of the punching step, the endless chains 131 are driven and the gripping bars 132 fixed to the endless chains 131 move so as to transfer the thin sheet material 50 having been subjected to the punching step, from the punching mechanism 120 to the waste removing mechanism 140. A new thin sheet material is supplied to the punching mechanism 120.

The waste removing mechanism 140 is provided with a rectangular frame body 141 and a female die 142. A plurality of pressing members (not shown) for pressing the waste portions are disposed movably and swingably on the frame body 141 so as to correspond to the number of the waste portions. The female die 142 is disposed so as to be opposite to the frame body 141 and provided with openings having the corresponding shape to the waste portions to be removed.

Now, description will be given of the punching operation with the use of the conventional automatic punching apparatus 100 having the above-described structure. First, the thin sheet materials are placed in a stacked condition on the feed mechanism 110 so that the front edges of the thin sheet materials are trued up. The single thin sheet material 50 placing in the prescribed position is fed to the punching mechanism 120. The nipping mechanism 133 of the thin sheet material transferring mechanism nips the front end of the thus fed thin sheet material 50. The thin sheet material 50, which is in such a nipped condition, is pulled in the punching mechanism 120 along with the movement of the endless chains 131 and the gripping bars 132. The thin sheet material 50 is finally placed between the upper and lower dies of the punching mechanism 120 in an interval of punching steps.

Moving the lower surface plate 122 upward relative to the upper surface plate 121 so as to punch the thin sheet material 50 carries out the punching step. Portions on the cutting line of the thin sheet material 50 are caused to remain uncut to form uncut portions so as to prevent the waste portions from falling down from the punched product after the completion of the punching step to cause the inconvenience in the subsequent punching step. The thin sheet material 50 having been subjected to the punching step is transferred from the punching mechanism 120 to the female die 142 of the waste removing mechanism 140 due to the movement of the endless chains 131 and the gripping bars 132 so as to locate in a proper position on the female die 142. proper position on the female die 142.

The frame body 141 disposed right above the female die 142 moves downward to press the waste portions down from the upper side so as to perform a waste removing motion. Such a waste removing motion causes the uncut portions to be sheared so as to drop the waste portions into the opening of the female die 144, thus removing the waste portions. The complete removal of the thus formed punched product from the thin sheet material whose front end is nipped by the nipping mechanism 133 is carried out and the punched product is fed to the subsequent step. The nip of the remaining portion of the thin sheet material by the nipping mechanism 133 is released during a returning step to the punching mechanism 120, and the remaining portion is then discharged as wastes.

According to the above-described conventional automatic punching apparatus 100, the punching step and the waste removing step are carried out, while the thin sheet material 50 is transferred in a condition of nipping the thin sheet material 50 by means of the nipping mechanism 133 of the gripping bars 132. It is therefore possible to transfer the thin sheet material 50 at a high speed in a stable condition so that a large amount of the thin sheet materials can be treated for a short period of time.

The other conventional automatic punching apparatus having the different structure is disclosed in Japanese Utility Model Publication No. H7-54,188, which is shown in FIGS. 8 and 9. FIG. 8 is a schematic constructional view of the other conventional automatic punching apparatus and FIGS. 9(A) and 9(B) are side and longitudinal sectional view of the essential portion of the apparatus, respectively.

The other conventional automatic punching apparatus 200 as shown in the above-mentioned figures is composed of a feed mechanism 210 having a feed conveyor 211 for feeding the thin sheet material; a punching mechanism 220 disposed to stand behind the feed mechanism 210, for punching the thin sheet material 50 into a prescribed shape by means of upper and lower dies; a thin sheet material transferring mechanism 230 disposed on the opposite side and the upper side of the punching mechanism 220, for transferring the thin sheet material 50 having been subjected to the punching step from the punching mechanism 220; and a waste removing mechanism 240 disposed behind the punching mechanism 120, for removing the waste portions from the thin sheet material 50 having been subjected to the punching step.

The punching mechanism 220 is provided with an upper surface plate 221 to which the punching die is fixed; a lower surface plate 222 to which a faceplate is fixed; and an elevating device 223 for moving the lower surface plate 222 up and down. The lower surface plate 222 has guide grooves 224 formed on the opposite surface sides of the lower surface plate 222. An interlocking device having a prescribed structure is disposed between the punching mechanism 220 and the feed mechanism 210, for driving the feed conveyor 211 in an interlocking motion with the movement of the lower surface plate 222 by means of the elevating device 223. The supply of the thin sheet material 50 to the punching mechanism 220 by means of the feed conveyor 211 is repeated after the completion of the punching step.

The thin sheet material transferring mechanism 230 is provided with a pair of endless chains 231 spreading over the both sides and the upper side of the punching mechanism 220, so as to circulate in a prescribed travelling direction; a driving device 232 for driving the endless chains 231 in a circulation motion in synchronization with the up-and-down movement of the lower surface plate 222; chain attachments 233 secured to the opposite positions of the pair of endless chains 231, respectively; a scraping bar 234 fixed to the chain attachments 233 so as to be held therebetween, which is capable of passing between the upper and lower surface plates toward a side of the waste removing mechanism 240 in an interval of punching steps so as to press the thin sheet material 50 remaining on the lower surface plate 222 to the waste removing mechanism 240. Rollers 235 are rotatably provided on the lower portion of the connection member of the chain attachment 233 with the endless chain 231. The rollers 235 roll in the guide grooves 224 of the lower surface plate 222 so that the chain attachments 233 are interlocked with the up-and-down movement of the lower surface plate 222. Accordingly, unfavorable up-and-down movement of the chain attachments 233 can be prevented and the gap between the scraping bar 234 and the lower surface plate 222 can be kept constant.

The thin sheet material transferring mechanism 230 has a construction that the endless chains 231 can accurately be operated by the driving device 232 in synchronization with the up-and-down movement of the lower surface plate 222 and their operation can appropriately be stopped. The operation of the endless chains 231 is stopped during the punching step of the thin sheet material 50 in the punching mechanism 220. After the completion of the punching step, the endless chains 231 operate and the scraping bar 234 mounted thereon moves in order to discharge the thin sheet material 50 having been subjected to the punching step from the punching mechanism 220 into the waste removing mechanism 240.

The waste removing mechanism 240 is provided with a transferring conveyor 241 for transferring the thin sheet material 50 discharged from the punching mechanism to a place in which the subsequent step is to be carried out, and with a removing conveyor 242 disposed behind the transferring conveyor 241. The removing conveyor 242 has a plurality of pulleys 243 disposed so as to be rotatable and adjustable in their positions in the transverse direction; an endless belt 244 spreading over the pulleys 243 so as to be driven in a circulation motion; and waste removing rollers 245 for causing the occurrence of the wavy motion of the endless belt 244. In the above-described waste removing mechanism 240, the position of the endless belt 244 is adjusted in the transverse direction taking into consideration the position, shape and size of the waste portions of the thin sheet material 50 having been subjected to the punching step, permitting to effectively remove the waste portions from the thin sheet material 50.

Then, description will be given of the punching operation by means of the other conventional automatic punching apparatus 200 having the above-described structure. The thin sheet materials are fed one by one to the punching mechanism 220 by means of the feed conveyor 211 of the feed mechanism 210 so that the single thin sheet material 50 locates between the upper and lower dies of the punching mechanism 220 in an interval of the punching steps. The scraping bar 234 of the thin sheet material transferring mechanism 230 comes into contact with the rear portion of the thin sheet material 50 locating in the punching mechanism 220.

The punching step is carried out so as to separate completely the cut portions. The ascent of the lower surface plate 222 relative to the upper surface plate 221 causes the thin sheet material 50 to be punched. After the completion of the punching step, the thin sheet material 50 and waste portions separated therefrom are pushed out toward the waste removing mechanism 240 along with the movement of the endless chains 231 and the scraping bar 234.

After the thin sheet material 50 having been subjected to the punching step is transferred on the removing conveyor 242 by means of the transferring conveyor 241, the waste removing rollers 245 are driven to cause the occurrence of the wavy motion of the endless belt 244 so as to perform the waste removing motion, thus permitting the complete separation of the waste portions from the punched products to remove the waste portions. The punched products completely separated from the waste portions are transferred to a place in which the subsequent step is to be carried out.

In the above-described other conventional automatic punching apparatus 200, the thin sheet material 50 having been subjected to the punching step can completely be discharged from the lower surface plate 222 by means of the scraping bar 234 that moves so as to keep the gap between the lower surface plate 222 and the scraping bar 234 constant. As a result, the punching step can be carried out so as to permit the complete separation of the punched products from the waste portions, leading to an excellent finishing condition of the products.

The conventional automatic punching apparatus have the above-described constructions. In the former conventional apparatus, a high-speed transfer of the thin sheet material 50 can be conducted. However, it is necessary to form uncut portions so as to prevent the waste portions from falling down from the punched product after the completion of the punching step to cause the inconvenience in the subsequent punching step. A larger number of uncut portions are required according as the thin sheet material 50 is transferred from the punching mechanism 120 at a higher speed. When the punched product is separated from the waste portion after the transfer of the thin sheet material 50 from the punching mechanism, the uncut portions must be torn. The large number of uncut portions leads to an unfavorable finishing condition of the product.

The waste portion is pressed out and separated from the product by means of the waste removing mechanism 140 for separating the product from the waste portion. It is necessary to adjust accurately the position of the pressing members so as to case the portion for pressing the waste to come into contact only with the waste. Such adjustment requires time and effort. In addition, the adjustment has newly to be made at the time when the shape of the punched product is changed, requiring a lot of time for the adjustment operation. The punching of a lot of kinds of products cannot be carried out effectively, thus causing unfavorable problems.

In the latter conventional apparatus, the thin sheet material 50 having been subjected to the punching step are pressed out and discharged. Accordingly, even when portions coming out from the thin sheet material 50 are produced in the punching mechanism 220, they can be surely discharged in a lump. The cutting is conducted so as to make a complete separation of the waste portion from the thin sheet material 50 in the punching mechanism 220, leading to a good finishing condition of the product. However, when the transferring speed of the thin sheet material 50 increases, there occurs an unstable movement of the thin sheet material 50, which is pushed out by means of the scraping bar 234. As a result, it is hard to make a proper adjustment in the waste removing mechanism 240. A high-speed operation cannot be achieved and the punching of a large amount of products cannot be carried out effectively, thus causing unfavorable problems.

SUMMARY OF THE INVENTION

An object of the present invention, which was made in order to solve the above-described problems, is therefore to provide an automatic punching apparatus, which permits to transfer the thin sheet material at a high speed, to discharge surely all the thin sheet materials having been subjected to the punching step from the punching mechanism, to perform the punching operation by which excellent finishing conditions of the product can be given, and to shorten the required time for the entire punching operation.

In order to attain the aforementioned object, the automatic punching apparatus of the present invention comprises a feed mechanism for intermittently feeding a thin sheet material one by one to a subsequent zone; a punching mechanism for punching the thin sheet material into a prescribed shape by means of an upper die; a thin sheet material transferring mechanism disposed in a vicinity of the punching mechanism, for supplying the thin sheet material fed from the feed mechanism to the punching mechanism and transferring the thin sheet material from the punching mechanism; and a waste removing mechanism for removing disused portions from the thin sheet material having been subjected to a punching step, wherein:

the thin sheet material transferring mechanism comprises a pair of endless chains disposed on both sides, respectively, between which the punching mechanism and the waste removing mechanism locate, the endless chains being capable of circulating in a prescribed travelling direction; a driving device for driving the endless chains in a circulation motion in synchronization with a punching motion of the punching mechanism; a scraping bar disposed between positions corresponding to the pair of endless chains, which is capable of passing between the upper die and a lower die of the punching mechanism toward a side of the waste removing mechanism in an interval of punching steps so as to push out disused portions remaining on the lower die into the waste removing mechanism; and a nipping mechanism disposed behind the scraping bar in a travelling direction thereof, for nipping detachably a tip end portion of the thin sheet material so as to permit to pull out the thin sheet material along with movement of the scraping bar.

In the present invention, the scraping bar is disposed between the positions corresponding to the pair of endless chains of the thin sheet material transferring member, the nipping mechanism is disposed behind the scraping bar in the travelling direction thereof, the thin sheet material having been subjected to the punching step, which is nipped by means of the nipping mechanism, is pulled together with the scraping bar to carry out a transfer step, and the disused portions of the thin sheet material remaining on the lower die is pushed out by means of the other scraping bar subsequently passing between the upper and lower dies. Accordingly, it is possible to transfer the thin sheet material in a stable manner by means of the scraping bar, thus permitting to carry out a high-speed transfer step. Even if the disused portions remain between the upper and lower dies, they can surely be discharged. As a result, there is no need for formation of uncut portions between portions to be punched into a prescribed shape and the remaining disused portions and the punched products after the separation of the disused portions has an excellent finishing condition.

The above-described automatic punching apparatus of the present invention may further comprises a guide device for guiding at least lower end of the scraping bar to follow change in a vertical position of the lower die so as to maintain a prescribed distance between the lower end of the scraping bar and an upper surface of the lower die during causing the scraping bar to pass between the upper and lower dies of the punching mechanism. In the present invention having such an optional feature, the guide device is disposed to guide at least low end of the scraping bar so as to maintain a prescribed distance between the lower die and the lower end of the scraping bar, which is in the travelling condition. Accordingly, it is possible to move surely the lower end of the scraping bar along the upper surface of the lower die to push out the disused portions to discharge them, even when the lower die moves. There is no need for a stop of the movement of the lower die prior to the movement of the scraping bar so as to carry out continuously a series of steps including the punching step and the scraping bar-transferring step, thus permitting to reduce the working time of period and accelerate the working operation.

In the above-mentioned automatic punching apparatus of the present invention, there may be provided, as the guide device, guide members having a prescribed width, the guide members being disposed horizontally on both sides of the lower die so as to be integral therewith; the scraping bar may be provided at its opposite sides integrally with members to be guided, which can engage with the guide members in conditions that the members to be guided are movable in a horizontal direction and immovable in a vertical direction relative to the guide members; and engagement of the members to be guided with the guide members during passing of the scraping bar between the upper and lower dies may cause an entirety of the scraping bar to follow the change in the vertical position of the lower die. In the present invention having such an optional feature, the guide members serving as the guide device are disposed on the both sides of the lower die, the scraping bar has at its opposite sides the members to be guided, which can engage with the guide member, these members to be guided engage with the guide member to guide them and the entirety of the scraping bar is caused to follow the change in the vertical position of the lower die. Accordingly, it is possible to move surely the lower end of the scraping bar along the upper surface of the lower die to push out the disused portions to discharge them, even when the lower die moves and to carry out continuously a series of steps including the punching step and the scraping bar-transferring step, thus permitting to reduce the working time of period and accelerate further the working operation.

In the above-mentioned automatic punching apparatus of the present invention, the guide members may be formed as groove portions having a prescribed width, which extend at opposite sides of the lower die in a horizontal direction; the members to be guided of the scraping bar may be disposed on lower zones of connection portions of the opposite ends of the scraping bar with the endless chains so as to project toward the lower die, the members to be guided being formed as guide rollers, which are rotatable around axes perpendicular to the travelling direction of the scraping bar and a vertical direction thereof; and the guide rollers may roll and pass through the guide members during passing of the scraping bar between the upper and lower dies. In the present invention having such an optional feature, the guide members serving as the guide device are formed as the groove portions, the members to be guided, which engages with the guide members, is formed as the guide rollers, and the guide rollers travel in the groove portions while rolling and coming into contact with them so that the whole of the scraping bar can move up and down to follow the change in the vertical position of the lower die. Accordingly, it is possible to move surely the scraping bar along the upper surface of the lower die to discharge the disused portions, thus permitting to accelerate further the working operation. The smooth travel of the guide rollers in the groove portions can reduce the contact resistance and decrease the load for driving the endless chain to move the scraping bar.

In the above-mentioned automatic punching apparatus of the present invention, there may be provided, as the guide device, chain guide members having a prescribed shape, the chain guide members being capable of guiding prescribed portions of the endless chains travelling on sides of the lower die to follow the change in the vertical position of the lower die so as to maintain a constant relationship in relative height to the lower die; and the travel of the endless chains along the chain guide members during passing of the scraping bar between the upper and lower dies may cause the entirety of the scraping bar to follow the change in the vertical position of the lower die. In the present invention having such an optional feature, the chain guide members are provided for guiding the prescribed portions of the endless chains to follow the change in the vertical position of the lower die so as to maintain the constant relationship in relative height to the lower die, and the entirety of the scraping bar can move up and down to follow the change in the vertical position of the lower die while the endless chains are guided by means of the chain guide members. Accordingly, it is possible to move surely the scraping bar along the upper surface of the lower die to discharge the disused portions, even when the lower die moves and to carry out continuously a series of steps including the punching step and the scraping bar-transferring step, thus permitting to reduce the working time of period and accelerate further the working operation.

In the above-mentioned automatic punching apparatus of the present invention, the waste removing mechanism may comprises: a plurality of rotatable pulleys disposed so as to be adjustable in their disposal position in a horizontal direction; a plurality of endless belts, which are supported by the pulleys to drive in a circulation motion so that upper portions of the endless belts travel from a side of the punching mechanism toward a forward side thereof and lower portions thereof travel in a returning direction to a side of the punching mechanism; and a waste removing roller disposed so as to be movable in a horizontal direction together with the pulleys and the endless belts and rotatable, the waste removing roller having a function of imparting a vertical oscillation motion to the endless belts. In the present invention having such an optional feature, there are provided, as the waste removing mechanism, the endless belts supported by the pulleys to drive in the circulation motion and the waste removing roller having a function of imparting a vertical oscillation motion to the endless belts. In the present invention having such an optional feature, it is possible to separate the punched products from the disused portions with the use of the simple structure by imparting the oscillation motion to the endless belts by the waste removing roller and transmitting the oscillation to the thin sheet material placed on the endless belts so as to cause the disused portions to fall down. In addition, when the adjustment of the components of the waste removing mechanism is carried out, the positional adjustment in the lateral direction suffices so that the adjustment operation can be easily conducted for the short period of time. As a result, when the punching pattern is changed frequently, it is possible to reduce the time required for carrying out the adjustment operation, thus improving the working efficiency and permitting to carry out the punching steps for the various kinds of products without causing any problems.

DETAILED DESCRIPTION OF THE PREFERRED EMBODIMENTS

Figure 1:
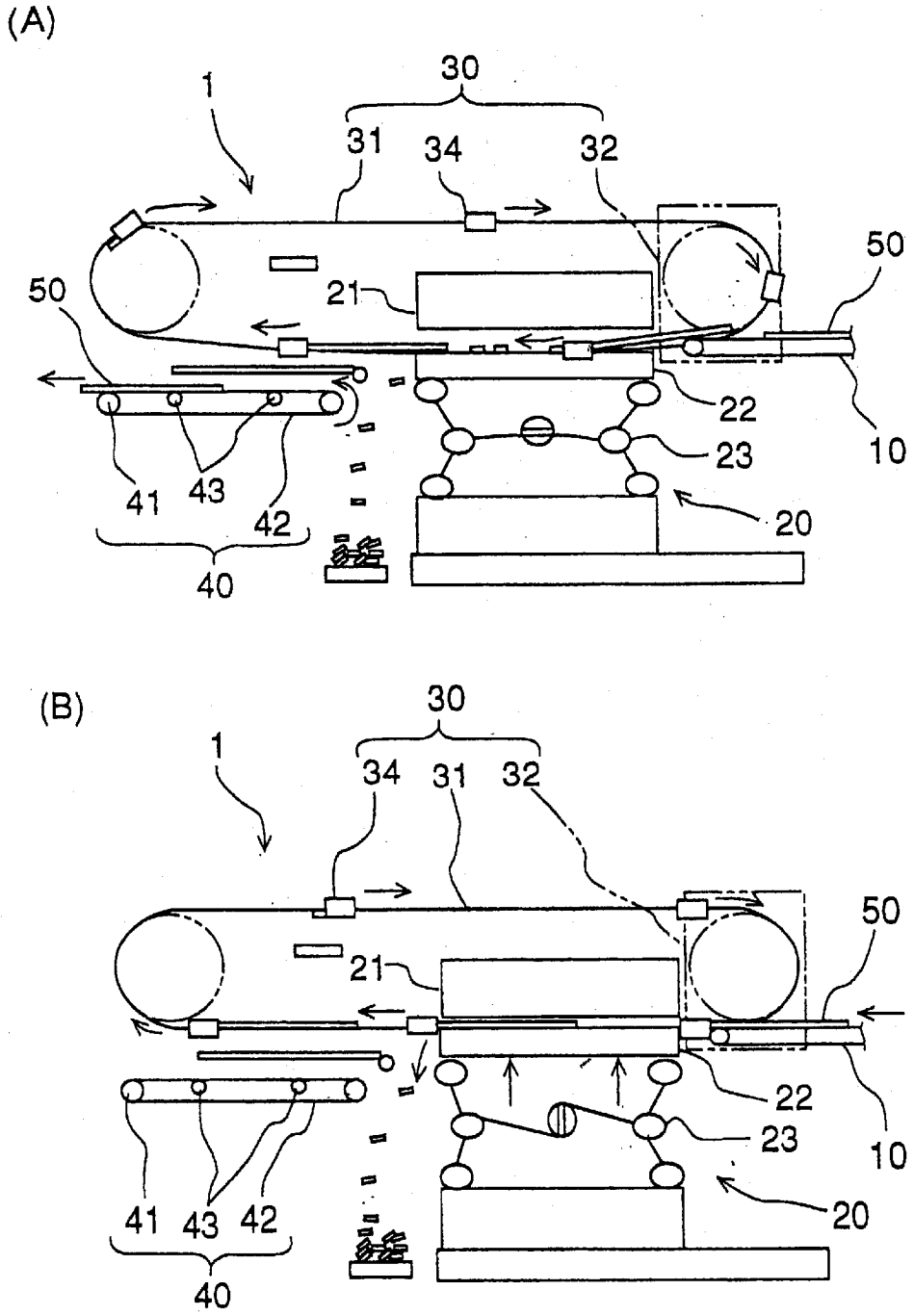
FIGS. 1(A) and 1(B) are descriptive views of the first half punching operation utilizing an automatic punching apparatus of an embodiment of the present invention.
Figure 2:
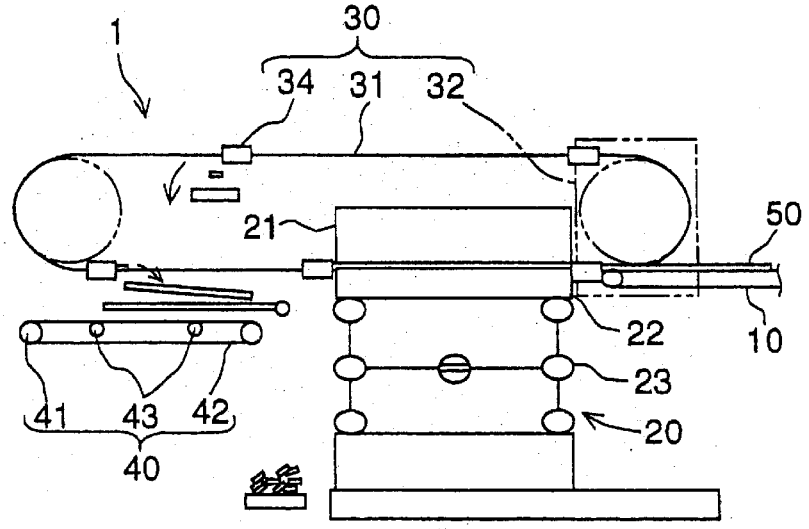
FIGS. 2(A) and 2(B) are descriptive views of the second half punching operation utilizing the automatic punching apparatus of the embodiment of the present invention.
Figure 2:
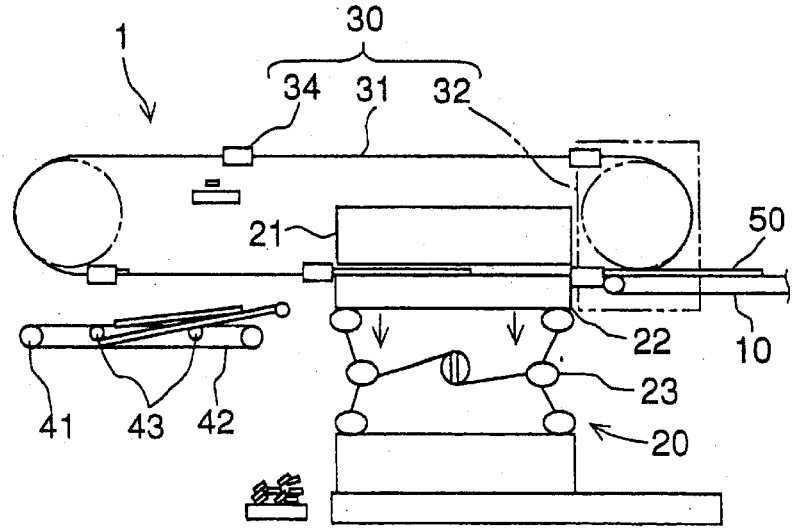
Figure 3:
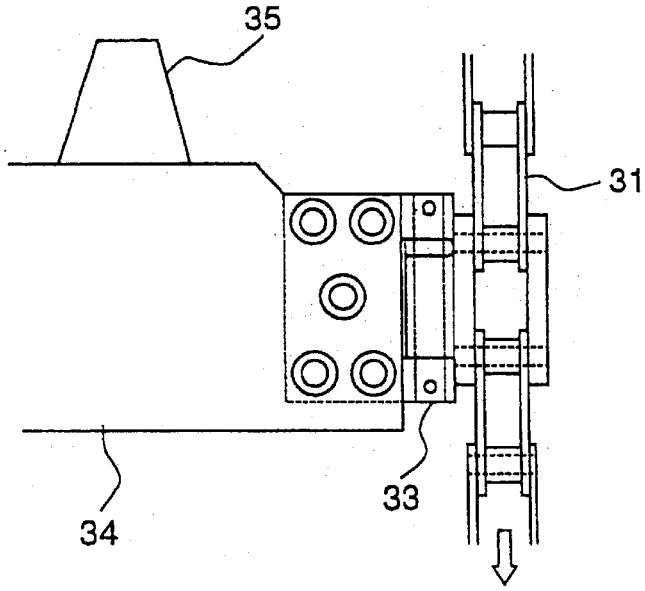
FIG. 3(A) is a plan view of essential components of the automatic punching apparatus of the embodiment of the present invention.
FIG. 3(B) is a side view of the apparatus and FIG. 3(C) is a cross sectional view of the apparatus.
Figure 3:
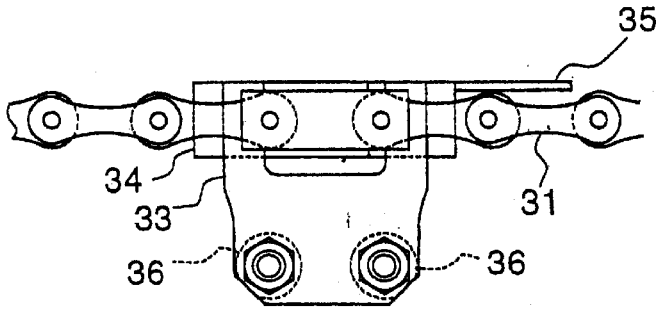
Figure 3:
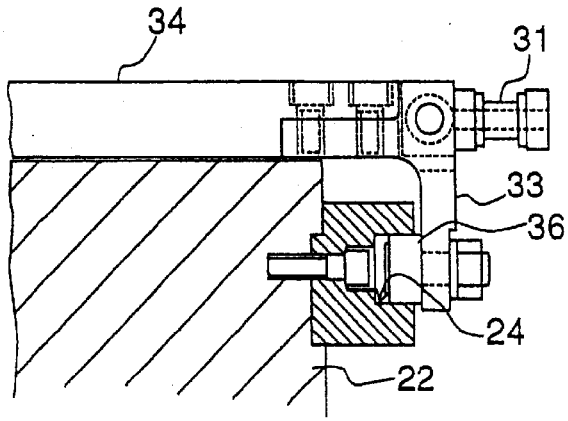
Figure 4:
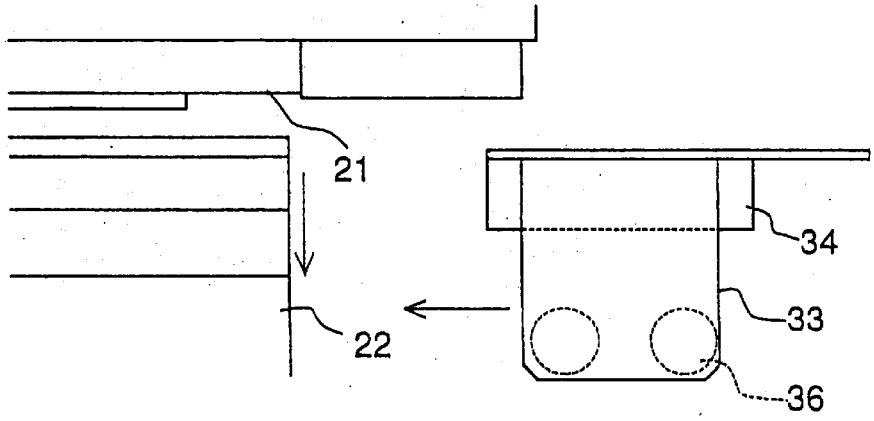
FIGS. 4(A), 4(B) and 4(C) are descriptive views illustrating conditions in which guide rollers enter guide grooves in the automatic punching apparatus of the embodiment of the present invention.
Figure 4:
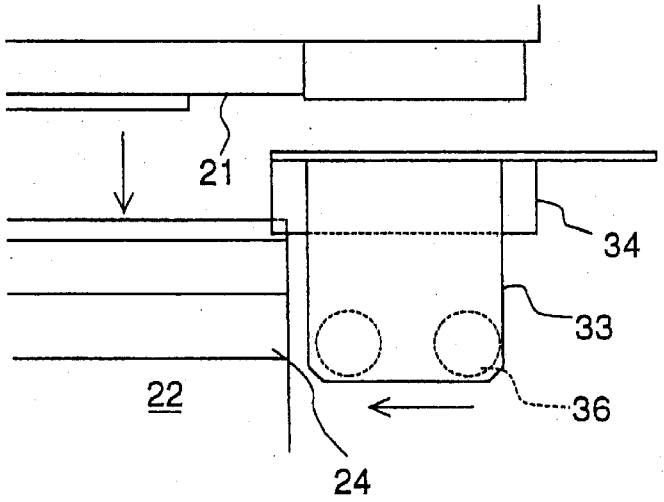
Figure 4:
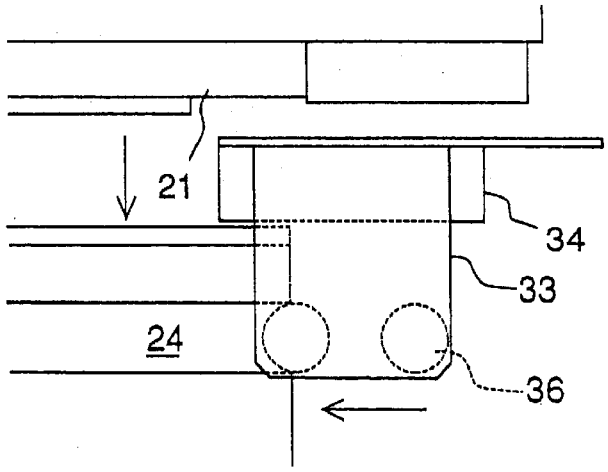
Figure 5:
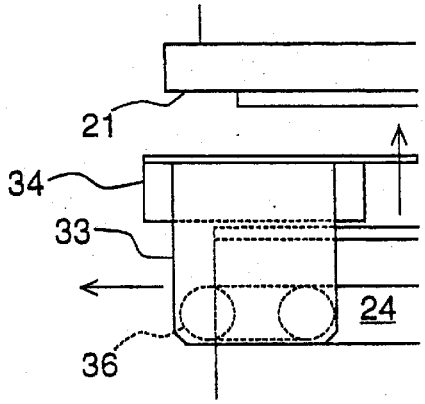
FIGS. 5(A), 5(B) and 5(C) are descriptive views illustrating conditions in which the guide rollers come off the guide groves in the automatic punching apparatus of the embodiment of the present invention.
Figure 5:
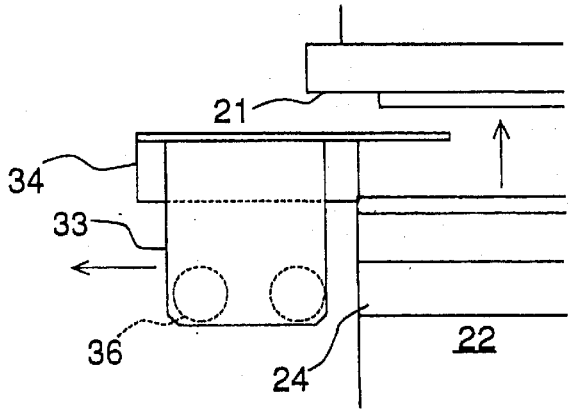
Figure 5:
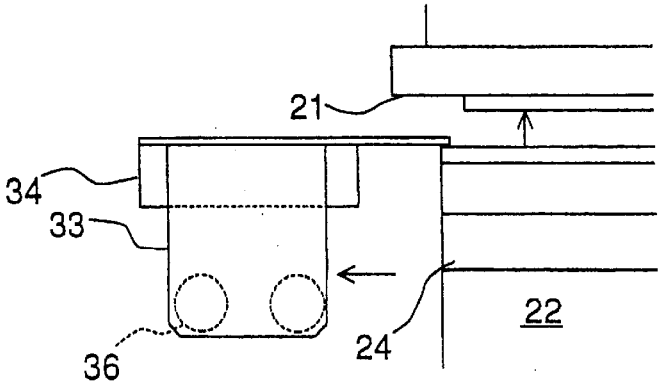
Figure 6:
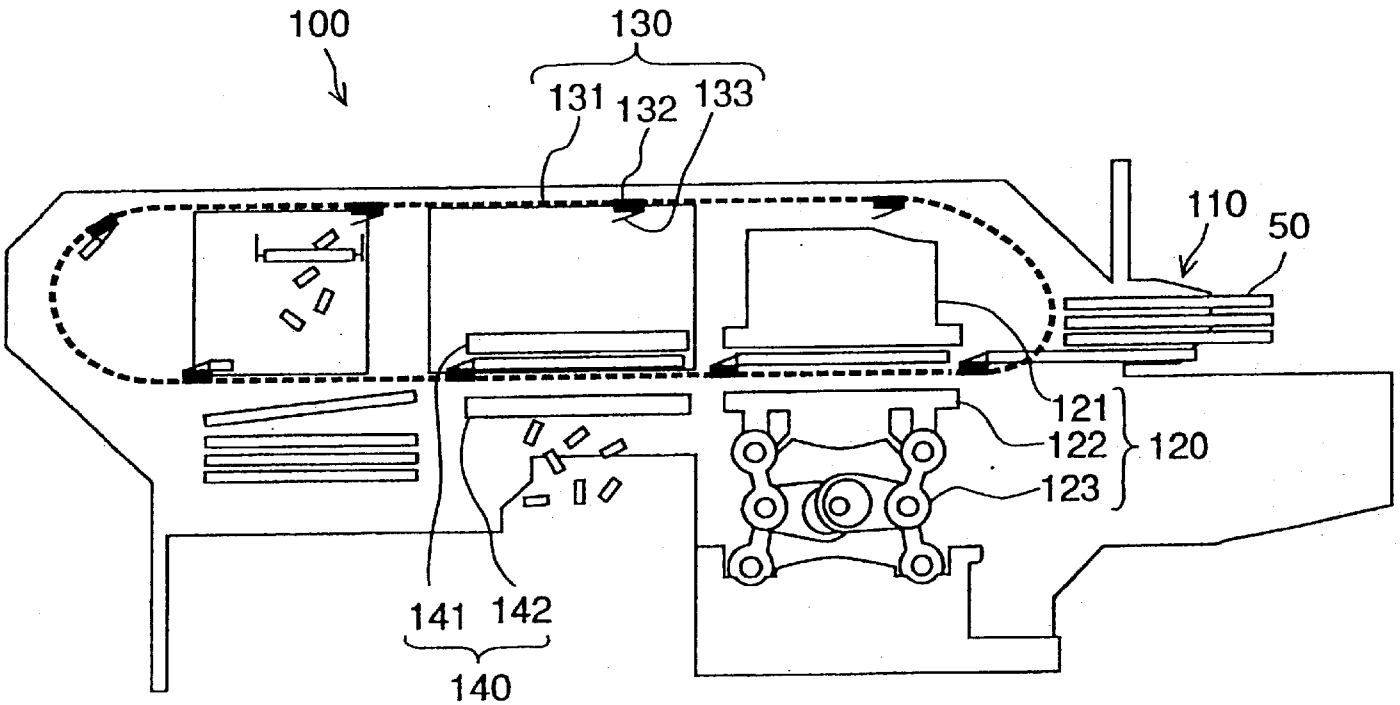
F I G. 6 (PRIOR ART)
FIG. 6 is a schematic constructional view of the conventional automatic punching apparatus.
Figure 7:
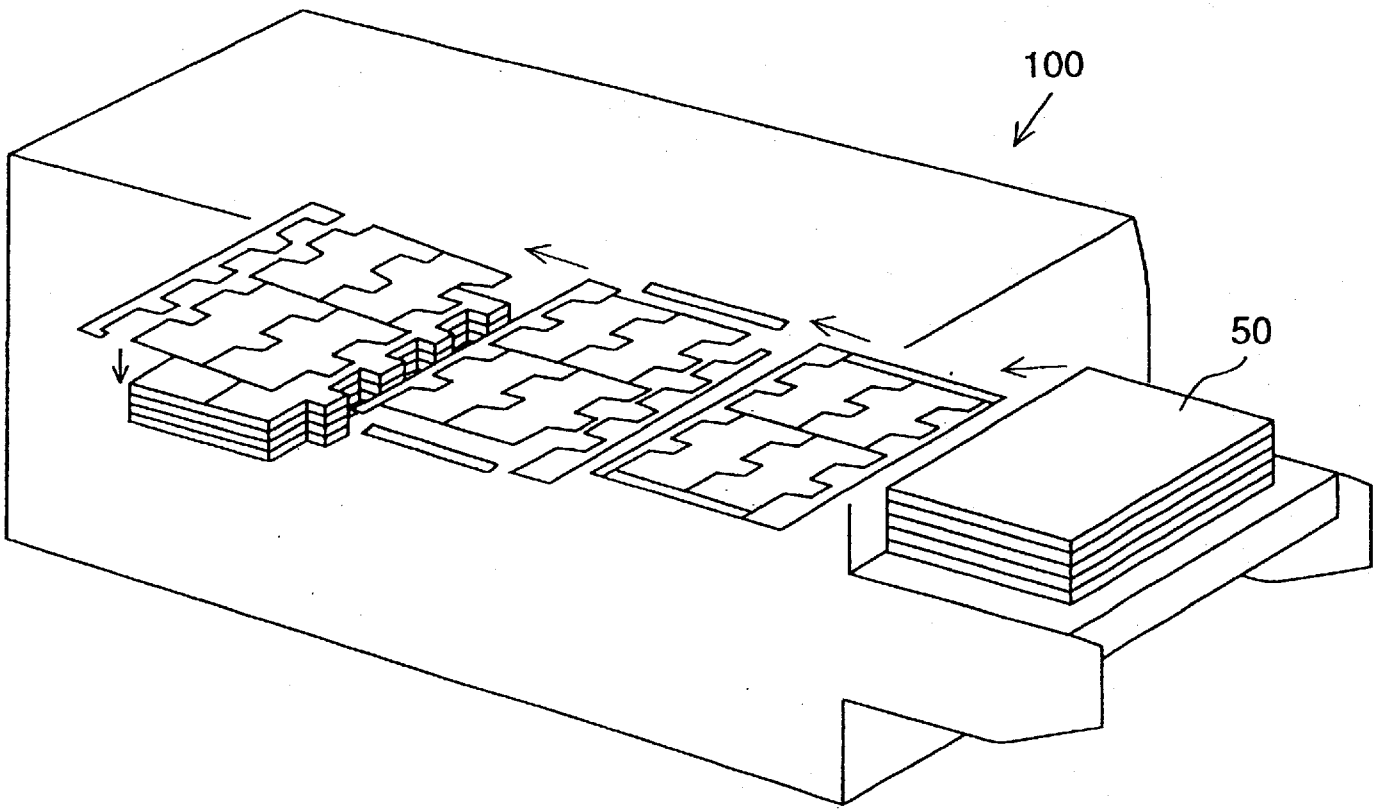
FIG. 7 (PRIOR ART)
FIG. 7 is a descriptive view illustrating conditions of thin sheet materials in the respective steps utilizing the conventional automatic punching apparatus.
Figure 8:
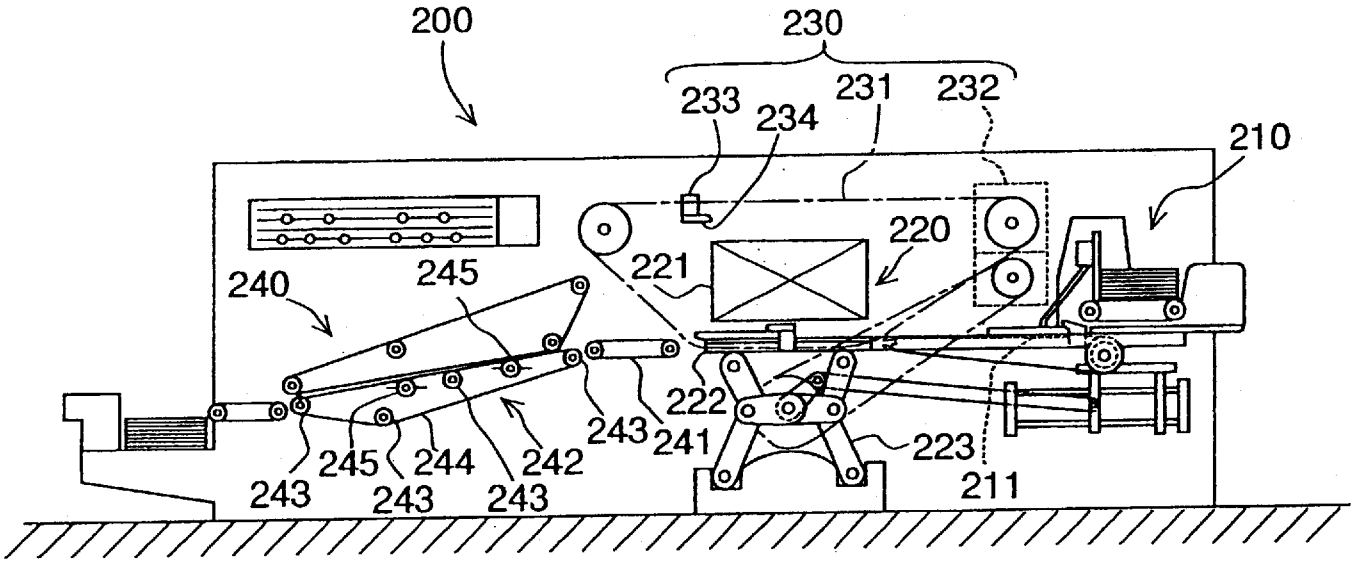
FIG. 8 (PRIOR ART)
FIG. 8 is a schematic constructional view of the other conventional automatic punching apparatus.
Figure 9:
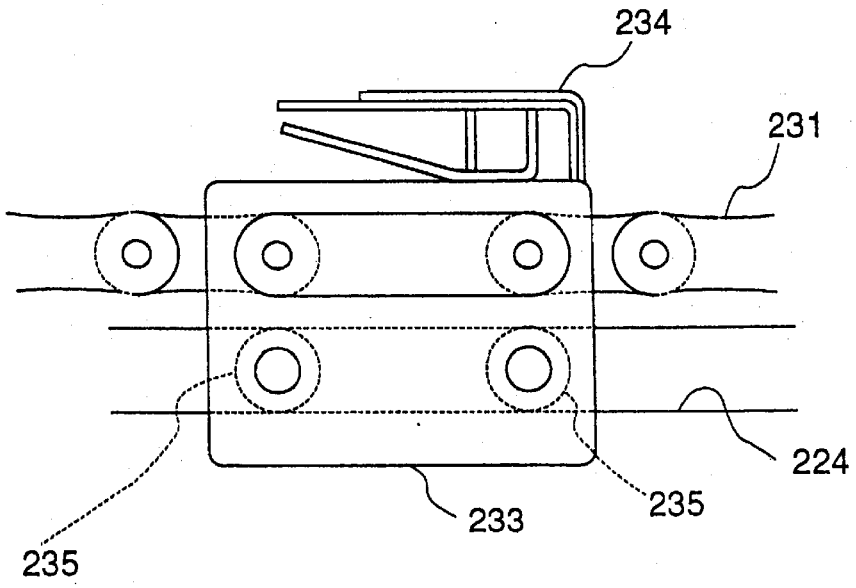
FIG. 9 (PRIOR ART)
FIG. 9(A) is a side view of essential components of the conventional apparatus as shown in FIG. 8
FIG. 9(B) is a cross sectional view of the apparatus.
Figure 9:
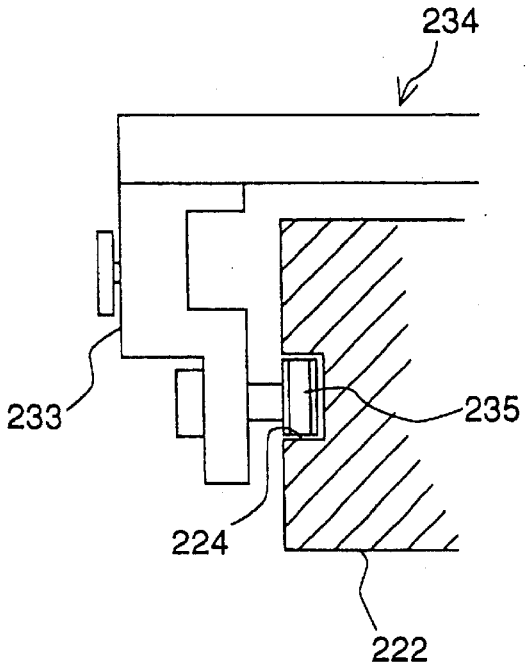
FIG. 9 (PRIOR ART)

Now, description will be given of an embodiment of an automatic punching apparatus of the present invention with reference to FIGS. 1 to 5. FIGS. 1(A) and 1(B) are descriptive views of the first half punching operation utilizing the automatic punching apparatus of the embodiment of the present invention; FIGS. 2(A) and 2(B) are descriptive views of the second half punching operation utilizing the automatic punching apparatus of the embodiment of the present invention; FIG. 3(A) is a plan view of essential components of the automatic punching apparatus of the embodiment of the present invention, FIG. 3(B) is a side view of the apparatus and FIG. 3(C) is a cross sectional view of the apparatus; FIGS. 4(A), 4(B) and 4(C) are descriptive views illustrating conditions in which guide rollers enter guide grooves in the automatic punching apparatus of the embodiment of the present invention; and FIGS. 5(A), 5(B) and 5(C) are descriptive views illustrating conditions in which the guide rollers come off the guide groves in the automatic punching apparatus of the embodiment of the present invention.

As is clear from each of these figures, the automatic punching apparatus 1 of the embodiment of the present invention comprises a feed conveyor 10 for feeding a thin sheet material 50; a punching mechanism 20 for punching the thin sheet material 50 into a prescribed shape by means of upper and lower dies; a thin sheet material transferring mechanism 30 disposed in the vicinity of the punching mechanism, for supplying the thin sheet material 50 fed from the feed conveyor 10, to the punching mechanism and transferring the thin sheet material 50 having been subjected to the punching step from the punching mechanism 20; and a waste removing mechanism 40 disposed behind the punching mechanism 20, for removing the waste portions from the thin sheet material 50 having been subjected to the punching step.

The punching mechanism 20 is provided with an upper surface plate 21 to which the punching die is fixed; a lower surface plate 22 to which a faceplate serving as a lower die corresponding to the punching die is fixed; and an elevating device 23 for moving the lower surface plate 22 up and down. The lower surface plate 22 has guide grooves 24 serving as the guide device, which are formed on the opposite surface sides of the lower surface plate 22 (see FIGS. 4 and 5).

The thin sheet material transferring mechanism 30 is provided with a pair of endless chains 31 disposed on both sides between which the punching mechanism 20 and the waste removing mechanism 40 locate, so as to circulate in a prescribed travelling direction; a driving device 32 for driving the endless chains 31 in a circulation motion in synchronization with the punching operation of the punching mechanism; a plurality of chain joints 33 secured to the opposite positions of the pair of endless chains 31, respectively; a scraping bar 34 fixed to the chain joints 33 so as to be held therebetween, which is capable of passing between the upper and lower surface plates toward a side of the waste removing mechanism 40 in an interval of punching steps so as to press the thin sheet material 50 remaining on the lower surface plate 22 to the waste removing mechanism 40; and a nipping mechanism disposed behind the scraping bar 34, for nipping detachably the tip end portion of the thin sheet material so as to permit to pull out the thin sheet material along with the movement of the scraping bar 34.

Guide rollers 36 are rotatably provided on the lower portion of the connection member of the chain joints 33 with the endless chains 31. The guide rollers 36 roll in the guide grooves 24 of the lower surface plate 22 so that the chain joints 33 are interlocked with the up-and-down movement of the lower surface plate 22. Accordingly, unfavorable up-and-down movement of the chain joints 33 can be prevented and the gap between the scraping bar 34 and the lower surface plate 22 can be kept constant (see FIG. 3).

The thin sheet material transferring mechanism 30 has a construction that the endless chains 31 can accurately be operated by the driving device 32 in synchronization with the up-and-down movement of the lower surface plate 22 and their operation can appropriately be stopped. The operation of the endless chains 31 is stopped during the punching step of the thin sheet material 50 in the punching mechanism 20. After the completion of the punching step, the endless chains 31 operate and the scraping bar 34 mounted thereon moves in order to discharge the thin sheet material 50 having been subjected to the punching step from the punching mechanism 20 into the waste removing mechanism 40 and to supply the new thin sheet material 50 to the punching mechanism 20 by means of the other scraping bar 34.

The waste removing mechanism 40 is provided with a plurality of pulleys 41 disposed so as to be rotatable and adjustable in their positions in the transverse direction; a plurality of endless belts 42 spreading over the pulleys 41 so as to be driven in a circulation motion in a direction to which the upper surface side of the endless belts 42 travels from the punching mechanism 20 to the subsequent devices; waste removing rollers 43 disposed so as to be movable in the transverse direction together with the pulleys 41 and the endless belts 42, for causing the occurrence of the wavy motion of the endless belts 42. In the above-described waste removing mechanism 40, the position of the endless belt 42 is adjusted in the transverse direction taking into consideration the position, shape and size of the waste portions of the thin sheet material 50 having been subjected to the punching step, permitting to effectively remove the waste portions from the thin sheet material 50.

Then, the description will be given of the punching operation by means of the automatic punching apparatus 1 having the above-described structure. The thin sheet materials 50 are fed one by one to the punching mechanism 20 by means of the feed conveyor 10. The nipping mechanism 35 of the thin sheet material transferring mechanism 30 nips the tip end portion of the thin sheet material 50 fed in this manner. The thin sheet material 50 is drawn in such a nipping condition into the punching mechanism 20 along with the movement of the endless chains 31 and the scraping bar 34. The scraping bar 34 passes between the upper and lower dies of the punching mechanism 20 in an interval of the punching steps so that the thin sheet material 50 locates between the upper and lower dies of the punching mechanism 20 (see FIG. 1). When the scraping bar 34 locates between the upper and lower dies of the punching mechanism 20, the guide rollers 36 of the chain joints 33 simultaneously enter the guide grooves 24 of the lower surface plate 22 (see FIG. 4). As a result, the chain joints 33 and the scraping bar 34 can move up and down together with the lower surface plate 22.

The punching step is carried out so as to separate completely the cut portions. The ascent of the lower surface plate 22 relative to the upper surface plate 21 causes the thin sheet material 50 to be punched (see FIG. 2(A)). After the lower surface plate 22 moves down to a prescribed position (see FIG. 2(*b*)), the thin sheet material 50 having been subjected to the punching step is transferred from the punching mechanism 20 to the waste removing mechanism 40 along with the movement of the endless chains 31 and the scraping bar 34 (see FIG. 1(A)). The waste portions fallen down on the lower surface plate 22 are pushed toward the waste removing mechanism 40 by the movement of the other scraping bar 34 to transfer the new thin sheet material 50 to the punching mechanism 20 (see FIG. 1). The guide rollers 36 of the chain joints 33 travel in the guide grooves 24 of the lower surface plate 22. Accordingly, the scraping bar 34, which moves between the upper and lower dies of the punching mechanism 20, travels toward the waste removing mechanism 40 in synchronization with the upward and downward movement of the lower surface plate 22, while maintaining a constant distance relative to the lower surface plate 22, thus carrying out surely the pushing step of the waste portions. When the scraping bar 34 comes away from the lower surface plate 22, the guide rollers 36 also come away from the guide grooves 24 of the lower surface plate 22 so as to relieve the interlocking relation of the scraping bar 34 with the lower surface plate 22 in the upward and downward movement (see FIG. 5).

The thin sheet material 50 having been subjected to the punching step is transferred above the waste removing mechanism 40 along with the movement of the endless chains 31 and the scraping bar 34 (see FIG. 1(B)). Then, the punched products are separated from the thin sheet material 50 having the tip end portion, which is nipped by means of the nipping mechanism 35 (see FIG. 2(A)) and the punched products fall to move to the waste removing mechanism 40 (see FIG. 2(B)).

The waste removing roller 43 is driven to apply the waste removing step to the punched products obtained from the thin sheet material 50 so as to impart the oscillation motion to the endless belts 42, thereby removing the waste portions from the punched products. The punched products, from which the waste portions have completely been removed, are transferred to a place in which the subsequent steps are to be carried out (see FIG. 1(A)). The nip of remaining portion of the thin sheet material 50 by means of the nipping mechanism 35 is relieved during the step for returning the endless chains 31 toward the punching mechanism 20 (see FIG. 2(A)), so that the remaining portion of the thin sheet material 50 is discharged as the waste.

According to the automatic punching apparatus of the embodiment of the present invention, the thin sheet material having been subjected to the punching step is transferred by nipping the thin sheet material by means of the nipping mechanism 35 and pulling it together with the scraping bar 34, and the waste portions fallen down on the lower surface plate 22 are pushed out by means of the other scraping bar 34 passing between the upper and lower surface plates. Accordingly, it is possible to transfer the thin sheet material 50 in a stable manner by means of the scraping bar 34, thus permitting to carry out a high-speed transfer step. Even if the waste portions remain on the lower surface plate 22, they can surely be discharged. As a result, there is no need for formation of uncut portions between the portions to be punched into a prescribed shape and the remaining disused portions and the punched products after the separation of the disused portions has an excellent finishing condition. It is therefore possible to separate the punched products from the disused portions with the use of the simple structure by imparting the oscillation motion to the endless belts 42 of the waste removing mechanism 40 by the waste removing roller 43 and transmitting the oscillation to the thin sheet material 50 placed on the endless belts 42 so as to cause the disused portions to fall down. In addition, when the adjustment of the components of the waste removing mechanism 40 is carried out, the positional adjustment in the lateral direction suffices so that the adjustment operation can be easily conducted for the short period of time. As a result, when the punching pattern is changed frequently, it is possible to reduce the time required for carrying out the adjustment operation, thus improving the working efficiency and permitting to carry out the punching steps for the various kinds of products without causing any problems.

In the above-described automatic punching apparatus of the embodiment of the present invention, there is provided the guide grooves 24 serving as the guide member for the scraping bar 34 and the member to be guided, which can engage with the guide groove is composed as the guide roller 36. The present invention is not limited to such a structure. There may be provided, as the guide member, an elongated guide protrusion extending horizontally on the opposite sides of the lower surface plate 22, and there may be provided, on the respective chain joints 33 on the opposite ends of the scraping bar 34, a member to be guided, which has a recess groove portion with the above-mentioned guide member can engage. There may be provided, as the guide member, a chain guide for causing the prescribed portion of the endless chain 31 to follow the lower surface plate 22 to maintain a constant relative distance to the lower surface plate 22, and the endless chain may travel along the chain guide. In such a case, the entirety of the scraping bar can move up and down to follow the change in vertical position of the lower surface plate 22 so that the scraping bar 34 can surely move along the upper surface of the lower surface plate 22 to discharge the waste portions even when the lower surface plate 22 is in the upward moving condition. It is therefore possible to carry out continuously a series of steps including the punching step and the scraping bar-transferring step, thus permitting to accelerate the working operation.

According to the present invention as described in detail, the scraping bar is disposed between the positions corresponding to the pair of endless chains of the thin sheet material transferring member, the nipping mechanism is disposed behind the scraping bar in the travelling direction thereof, the thin sheet material having been subjected to the punching step, which is nipped by means of the nipping mechanism, is pulled together with the scraping bar to carry out a transfer step, and the disused portions of the thin sheet material remaining on the lower die is pushed out by means of the other scraping bar subsequently passing between the upper and lower dies. Accordingly, it is possible to transfer the thin sheet material in a stable manner by means of the scraping bar, thus permitting to carry out a high-speed transfer step. Even if the disused portions remain between the upper and lower dies, they can surely be discharged. As a result, there is no need for formation of uncut portions between portions to be punched into a prescribed shape and the remaining disused portions and the punched products after the separation of the disused portions has an excellent finishing condition.

In the present invention, the guide device is disposed to guide at least low end of the scraping bar so as to maintain a prescribed distance between the lower die and the lower end of the scraping bar, which is in the travelling condition. Accordingly, it is possible to move surely the lower end of the scraping bar along the upper surface of the lower die to push out the disused portions to discharge them, even when the lower die moves. There is no need for a stop of the movement of the lower die prior to the movement of the scraping bar so as to carry out continuously a series of steps including the punching step and the scraping bar-transferring step, thus permitting to reduce the working time of period and accelerate the working operation.

In the present invention, the guide members serving as the guide device are disposed on the both sides of the lower die, the scraping bar has at its opposite sides the members to be guided, which can engage with the guide member, these members to be guided engage with the guide member to guide them and the entirety of the scraping bar is caused to follow the change in the vertical position of the lower die. Accordingly, it is possible to move surely the lower end of the scraping bar along the upper surface of the lower die to push out the disused portions to discharge them, even when the lower die moves and to carry out continuously a series of steps including the punching step and the scraping bar-transferring step, thus permitting to reduce the working time of period and accelerate further the working operation.

In the present invention, the guide members serving as the guide device are formed as the groove portions, the members to be guided, which engages with the guide members, is formed as the guide rollers, and the guide rollers travel in the groove portions while rolling and coming into contact with them so that the whole of the scraping bar can move up and down to follow the change in the vertical position of the lower die. Accordingly, it is possible to move surely the scraping bar along the upper surface of the lower die to discharge the disused portions, thus permitting to accelerate further the working operation. The smooth travel of the guide rollers in the groove portions can reduce the contact resistance and decrease the load for driving the endless chain to move the scraping bar.

In the present invention, the chain guide members are provided for guiding the prescribed portions of the endless chains to follow the change in the vertical position of the lower die so as to maintain the constant relationship in relative height to the lower die, and the entirety of the scraping bar can move up and down to follow the change in the vertical position of the lower die while the endless chains are guided by means of the chain guide members. Accordingly, it is possible to move surely the scraping bar along the upper surface of the lower die to discharge the disused portions, even when the lower die moves and to carry out continuously a series of steps including the punching step and the scraping bar-transferring step, thus permitting to reduce the working time of period and accelerate further the working operation.

In the present invention, there are provided, as the waste removing mechanism, the endless belts supported by the pulleys to drive in the circulation motion and the waste removing roller having a function of imparting a vertical oscillation motion to the endless belts. In the present invention having such an optional feature, it is possible to separate the punched products from the disused portions with the use of the simple structure by imparting the oscillation motion to the endless belts by the waste removing roller and transmitting the oscillation to the thin sheet material placed on the endless belts so as to cause the disused portions to fall down. In addition, when the adjustment of the components of the waste removing mechanism is carried out, the positional adjustment in the lateral direction suffices so that the adjustment operation can be easily conducted for the short period of time. As a result, when the punching pattern is changed frequently, it is possible to reduce the time required for carrying out the adjustment operation, thus improving the working efficiency and permitting to carry out the punching steps for the various kinds of products without causing any problems.

What is claimed is:

1. An automatic punching apparatus comprising:

a feed mechanism for intermittently feeding a thin sheet material one by one to a subsequent zone;

a punching mechanism for punching said thin sheet material into a prescribed shape by means of an upper die;

a thin sheet material transferring mechanism disposed in a vicinity of said punching mechanism, for supplying said thin sheet material fed from said feed mechanism to said punching mechanism and transferring the thin sheet material from said punching mechanism; and a waste removing mechanism for removing disused portions from the thin sheet material having been subjected to a punching step, wherein:

said thin sheet material transferring mechanism comprises:

a pair of endless chains disposed on both sides, respectively, between which said punching mechanism and said waste removing mechanism are located, said endless chains being capable of circulating in a prescribed travelling direction;

a driving device for driving said endless chains in a circulation motion in synchronization with a punching motion of said punching mechanism;

a chain joint secured to said endless chain;

a scraping bar fixed to said chain joint disposed between positions corresponding to said pair of endless chains, which is capable of passing between the upper die and a lower die of said punching mechanism toward a side of said waste removing mechanism in an interval of punching steps so as to push out disused portions remaining on the lower die into said waste removing mechanism; and a nipping mechanism fixed to and disposed behind said scraping bar in a travelling direction thereof, for nipping detachably a tip end portion of the thin sheet material so as to permit to pull out the thin sheet material along with movement of said scraping bar.

2. The apparatus as claimed in claim 1, further comprising:

a guide device for guiding at least lower end of said scraping bar to follow change in a vertical position of said lower die so as to maintain a prescribed distance between said lower end of said scraping bar and an upper surface of said lower die during causing said scraping bar to pass between the upper and lower dies of said punching mechanism.

3. The apparatus as claimed in claim 2, wherein:

there are provided, as said guide device, guide members having a prescribed width, said guide members being disposed horizontally on both sides of said lower die so as to be integral therewith;

said scraping bar is provided at its opposite sides integrally with members to be guided, which can engage with said guide members in conditions that said members to be guided are movable in a horizontal direction and immovable in a vertical direction relative to said guide members; and engagement of said members to be guided with said guide members during passing of said scraping bar between the upper and lower dies causes an entirety of said scraping bar to follow the change in the vertical position of said lower die.

4. The apparatus as claimed in claim 3, wherein:

said guide members are formed as groove portions having a prescribed width, which extend at opposite sides of said lower die in a horizontal direction;

said members to be guided of said scraping bar are disposed on lower zones of connection portions of the opposite ends of the scraping bar with the endless chains so as to project toward the lower die, said members to be guided being formed as guide rollers, which are rotatable around axes perpendicular to the travelling direction of the scraping bar and a vertical direction thereof; and said guide rollers can roll and pass through the guide members during passing of said scraping bar between the upper and lower dies.

5. The apparatus as claimed in claim 2, wherein:

there are provided, as said guide device, chain guide members having a prescribed shape, said chain guide members being capable of guiding prescribed portions of the endless chains travelling on sides of the lower die to follow the change in the vertical position of the lower die so as to maintain a constant relationship in relative height to the lower die; and travel of said endless chains along the chain guide members during passing of said scraping bar between the upper and lower dies causes an entirety of said scraping bar to follow the change in the vertical position of said lower die.

6. The apparatus as claimed in any one of claims 1 to 5, wherein:

said waste removing mechanism comprises:

a plurality of rotatable pulleys disposed so as to be adjustable in their disposal position in a horizontal direction;

a plurality of endless belts, which are supported by said pulleys to drive in a circulation motion so that upper portions of the endless belts travel from a side of the punching mechanism toward a forward side thereof and lower portions thereof travel in a returning direction to a side of the punching mechanism; and a waste removing roller disposed so as to be movable in a horizontal direction together with said pulleys and said endless belts and rotatable, said waste removing roller having a function of imparting a vertical oscillation motion to said endless belts.

* * * * *